United States Patent [19]

Sisson

[11] 4,418,867

[45] Dec. 6, 1983

[54] ELECTRICALLY CONTROLLED UNIT INJECTOR

[75] Inventor: Albert E. Sisson, Farmington Hills, Mich.

[73] Assignee: The Bendix Corporation, Southfield, Mich.

[21] Appl. No.: 364,813

[22] Filed: Apr. 2, 1982

[51] Int. Cl.[3] ..... F02M 47/02

[52] U.S. Cl. ..... 239/88; 239/125

[58] Field of Search ..... 239/88, 90, 91, 92, 239/93, 94, 95, 125, 585

[56] References Cited

U.S. PATENT DOCUMENTS

| | | | |
|---|---|---|---|
| 3,951,117 | 4/1976 | Perr | 123/496 |
| 4,235,374 | 11/1980 | Walter et al. | 239/91 X |
| 4,281,792 | 8/1981 | Sisson et al. | 239/91 X |

*Primary Examiner*—Jeffrey V. Nase
*Assistant Examiner*—Mary McCarthy
*Attorney, Agent, or Firm*—Markell Seitzman; Russel C. Wells

[57] ABSTRACT

An electrically controlled unit injector for a diesel engine wherein both timing of injection and the quantity of fuel premetered into the injector are controlled by a single solenoid. The control of the timing portion of the cycle is accomplished by a timing port of the valve which, when open, permits fuel to flow into the timing chamber and, when closed, operates against high pressure to shut off the flow of fuel from the timing chamber. The metering function is initiated by the upward travel of a metering plunger in response to the upward travel of a pumping plunger while the timing port of the valve is closed. Metering is terminated by a metering port of the valve which shuts off the supply of fuel to the metering chamber. The timing and metering ports of the valve are controlled by the single solenoid. Metering quantity control may be of the pressure-time or volumetric metering type.

12 Claims, 3 Drawing Figures

Fig-1
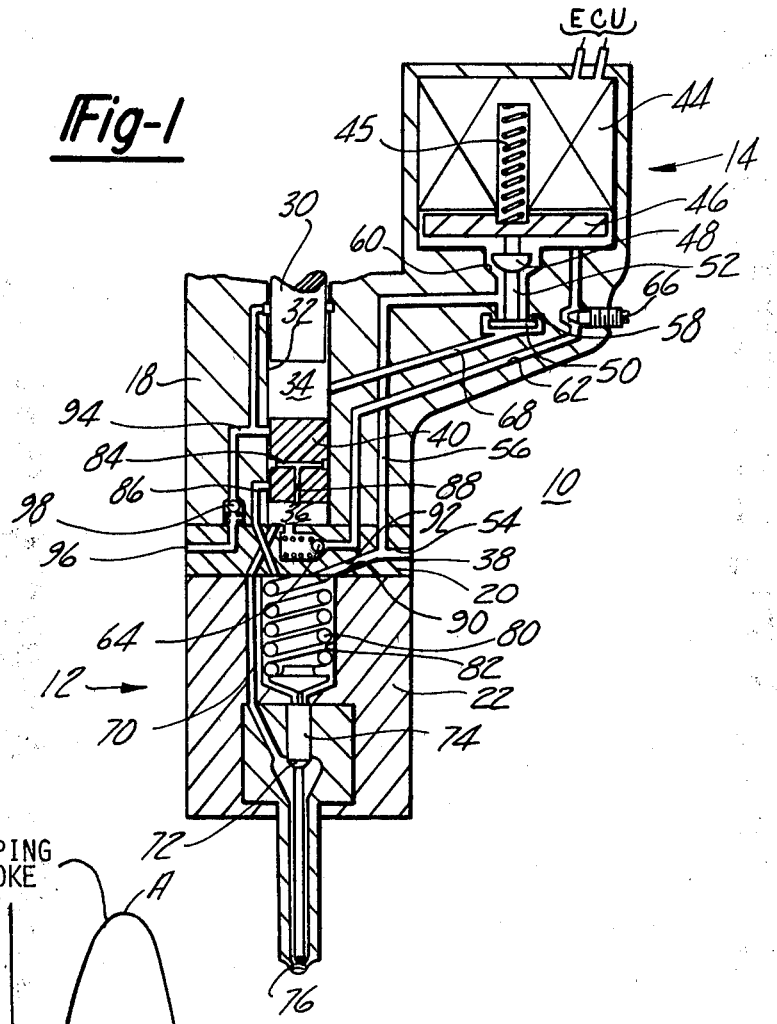
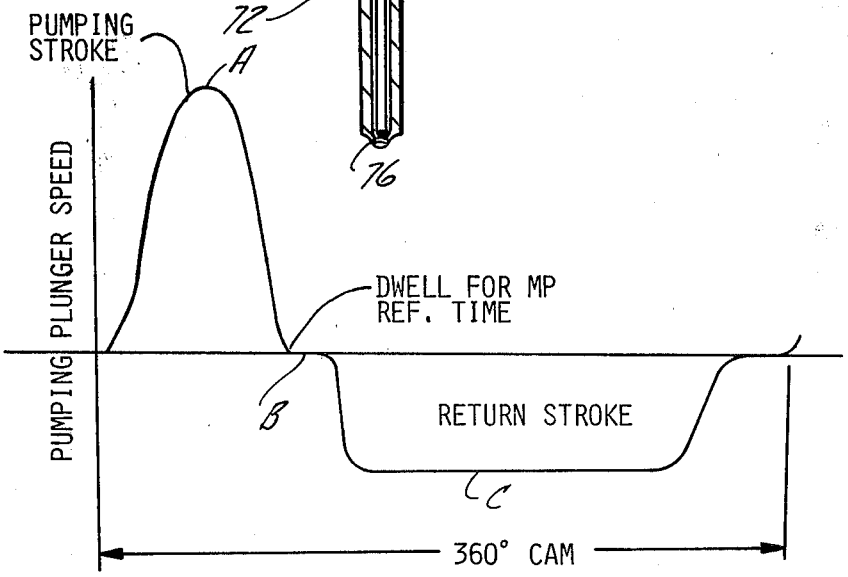
Fig-2

ELECTRICALLY CONTROLLED UNIT INJECTOR

CROSS-REFERENCE TO RELATED APPLICATIONS

This application is related to U.S. Pat. No. 4,281,792, issued to Messrs. Albert E. Sisson and Donald J. Lewis on Aug. 4, 1981, and assigned to the assignee of the instant invention, the disclosure of which is incorporated herein by reference.

BACKGROUND OF THE INVENTION

This invention relates generally to electrically controlled unit injectors, and more specifically to unit injectors having a timing function and metering function, both of which are controlled by a single solenoid, three-way valve unit.

Considerable development work is being done in the area of electrically controlled unit injectors, particularly to increase the precision with which the timing and metering functions are performed. The results of a portion of such development work are described in the above referenced patent issued to Messrs. Sisson and Lewis. In the Sisson-Lewis development, the metering phase of operation is terminated by opening a control valve and increasing the pressure in the timing chamber, thereby causing the metering plunger to stop when sufficient pressure is developed in the timing chamber. This system of terminating metering depends somewhat on the fluid dynamics of the fuel supply to the timing chamber and the dynamics of the metering plunger. While these dynamics can be readily accommodated, it has been found that cutting off the fuel supply to the metering chamber creates precise control of the amount of fuel in the metering chamber without significant regard for the above noted dynamics.

Also, an aspect of the fluid dynamics is the desirability of a large area passageway to the timing chamber, thus ensuring rapid pressurization of the timing chamber to quickly stop the travel of the metering plunger. In this situation, if the passageway is significantly long, the fuel in the passageway must be compressed, along with the fuel in the timing chamber, during injection. This additional fuel to be compressed places additional requirements on the cam profile to increase the speed of the pumping plunger at the start of injection.

In certain other designs, the fuel being supplied to the metering chamber is pressure regulated to effectively control the metering process. The elements associated with this regulator can add to the cost of the injector and provide additional design considerations.

As a general consideration, unit injectors of the type disclosed herein are well known. Consider for example the injector and system disclosed in the above referenced Sisson-Lewis patent and the art cited in connection with the filing and prosecution of that application.

In the Sisson-Lewis disclosure, a unit injector of the same general type as the unit injector of the instant invention is disclosed. In that disclosure, a fuel injector (10) is provided for each cylinder of an internal combustion engine, the injector including an electronically operated control valve (146) disposed between supply passage (42) and a timing chamber (98) to control the admission of fuel into and out of the timing chamber. A primary pumping plunger (62) and a secondary plunger (90) are axially spaced within the central bore of the injection body, and a normally closed injection nozzle (14) is situated at one end of the injector body. A mechanical linkage (27,28,30) associated with the camshaft of the engine drives the primary pumping plunger (62) against the bias of a main spring (18). The timing chamber (98) is defined between the plungers (62, 90) and a metering chamber (128) is defined between the secondary plunger (90) and the nozzle (14).

An electronic control unit (52) responds to engine operating conditions, and delivers a signal to the control valve (146) to close the valve and seal the timing chamber for a controlled period of time. The sealed timing chamber forms a hydraulic link, so that the plungers (62,90) move in concert during the injection and metering phases of the cycle of operation. When the signal from the ECU is terminated, the control valve opens, and breaks the hydraulic link so that the primary plunger (62) moves independently of the secondary plunger (90) which is biased in a set position by a spring (96) after termination of the control signal.

The timing function can be adjusted by the ECU relative to any preselected position of the crankshaft to optimize engine performance, while the metering function is achieved in a proportionate manner relative to the degree of camshaft rotation. A cam (22), having a linear portion, controls the mechanical linkage, and thus the primary pumping plunger (62), to produce the proportional metering function.

U.S. Pat. No. 3,951,117, granted Apr. 20, 1976 to Julius Perr, discloses a fuel supply system including hydraulic means for automatically adjusting the timing of fuel injection to optimize engine performance. The embodiment of the system shown in FIGS. 1–4 comprises an injection pump 17 including a body 151 having a charge chamber 153 and a timing chamber 154 formed therein. The charge chamber is connected to receive fuel from a first variable pressure fuel supply (such as valve 42, passage 44, and line 182), and the timing chamber is connected to receive fuel from a second variable pressure fuel supply over line 231, while being influenced by pressure modifying devices 222 and 223. The body further includes a passage 191 that leads through a distributor 187 which delivers the fuel sequentially to each injector 15 within a set of injectors.

A timing piston 156 is reciprocally mounted in the body of the injection pump in Perr between the charge and timing chambers, and a plunger 163 is reciprocally mounted in the body for exerting pressure on the fuel in the timing chamber. The fuel in the timing chamber forms a hydraulic link between the plunger and the timing piston, and the length of the link may be varied by controlling the quantity of fuel metered into the timing chamber. The quantity of fuel is a function of the pressure of the fuel supplied thereto, the pressure, in turn, being responsive to certain engine operating parameters, such as speed and load. Movement of the plunger 163 in an injection stroke results in movement of the hydraulic link and the timing piston, thereby forcing fuel into selected combustion chamber. The fuel in the timing chamber is spilled, or vented, at the end of each injection stroke into spill port 177 and spill passage 176. The mechanically driven fuel injector, per se, is shown in FIGS. 14–17.

SUMMARY OF THE INVENTION

The unit injector of the present invention provides a different approach to controlling the timing and metering functions of heretofore known injectors. In the unit injector of the present invention, the injector is controlled by a single solenoid, three-way valve configuration which provides precise control of the metered quantity of fuel while substantially reducing sensitivity of the control to design parameters. With the three-way valve, the valve having a high pressure portion and a low pressure portion, the high pressure portion is closed and the low pressure portion is open during metering. When it is desired to terminate metering, the high pressure portion is opened and the low pressure portion is closed, thus permitting flow of fuel to the timing chamber and cutting off the flow of fuel to the metering chamber. With this control of fuel flow, the metered quantity is precisely controlled without regard to the pressurizing of the timing chamber and the timing chamber may be filled at a rate which is not dependent on the metering control. Accordingly, relative pressures between the timing and metering chambers are not significant.

Also, since the flow rate to the timing chamber is not significant to the metering control, the supply passageway to the timing chamber may have a small area. This reduces the amount of fuel in the passageway to be compressed during injection timing, and accordingly reduces the speed with which the fluid must be pumped by the cam activated plunger.

Other areas of the injector of the present invention have been simplified over prior unit injector designs to reduce design considerations and cost. For example, the check valve in the supply passageway to the metering chamber may be a simple ball valve, or other similar type of valve, with a relatively light bias spring or in some designs, no spring at all. Further, the system may be operated at reduced pressure, and calibration of the metering function may be accomplished by a simple screw adjustment.

Accordingly, it is an object of the present invention to provide a simple and more precise control of a unit injector with a single control solenoid.

It is another object of the present invention to provide a unit injector wherein the metering function is terminated by shutting off the fuel supply to the metering chamber.

It is another object of the present invention to reduce the amount of fuel in fluid communication with the timing chamber which must be compressed immediately prior to injection.

It is a further object of the present invention to reduce the influence of design parameters on the timing and metering control functions.

Other objects, advantages and features of the invention will become readily apparent to the skilled artisan from an understanding of the specification and the attached drawings:

BRIEF DESCRIPTION OF THE DRAWINGS

In the drawings:

FIG. 1 is a schematic depiction of a preferred embodiment of the present invention and particularly illustrates the details of the three-way valve controlling the flow of fuel between the supply and the metering and timing chambers;

FIG. 2 is a graph illustrating the relationship between the degree of rotation of the cam shaft and the speed of the pumping plunger.

DETAILED DESCRIPTION OF THE DRAWINGS

Figure 3:
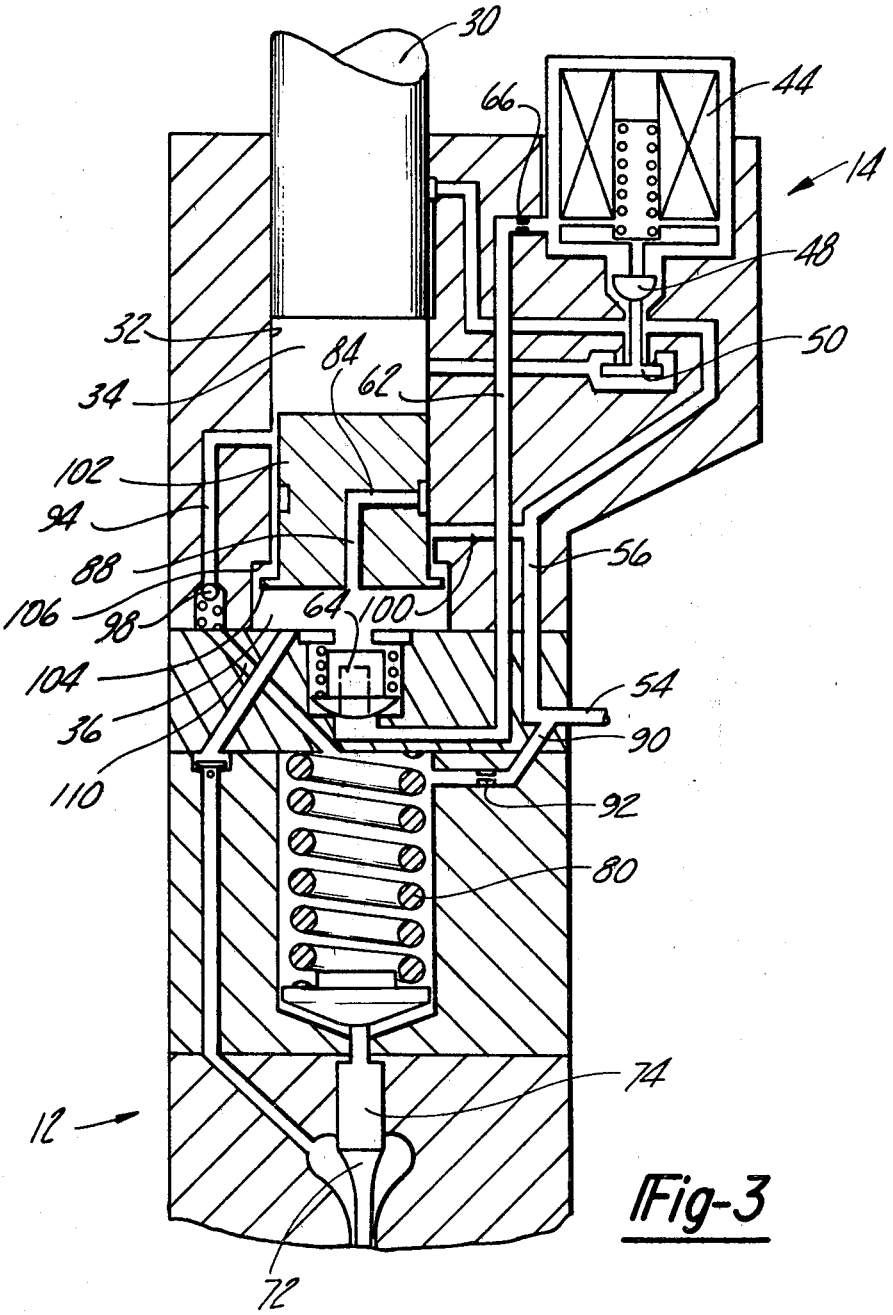
FIG. 3 is a schematic depiction of a modification of the embodiment of the invention shown in FIG. 1.

The system of the present invention will be described in the environment of a diesel engine having a unit injector for each cylinder of the diesel engine. Generally the fuel control system for such a diesel engine includes an electronic control unit (ECU) which receives engine operating parameters in the form of signal from sensors mounted to sense the various parameters of the engine. The electronic control unit provides output signals for each of the unit injectors through a solenoid control unit circuit which may form a part of the electronic control unit. As will be seen from the description of the invention, the unit injector (10) includes a main body (12) having an output nozzle (22) through which fuel is injected into the cylinders of the engine, the operation of the injector being controlled by a solenoid unit. The solenoid unit receives the control signals from the electronic control unit. Details of a system such as that described above can be best appreciated from a review of the above noted Sisson-Lewis U.S. Pat. No. 4,281,792. In view of the similarity of operation of the unit injector of the instant invention with that described in the patent, specific details of the operation will be omitted from this disclosure and the reader is referred to the above referenced patent for those details.

Referring now to FIG. 1, there is illustrated a unit injector 10, the main components of which are a body element 12 and a three-way control valve or solenoid generally designated as 14. The injector body 12 is generally divided into three portions, a timing and metering chamber portion 18, a control passageway portion 20 and a nozzle portion 22. The timing and metering chamber portion 18 includes a pumping plunger 30 which is reciprocally driven by a rocker arm (not shown), which is in turn driven by a cam associated with the rotation of a cam shaft mounted in the engine. Accordingly, the pumping plunger 30 moves up and down in response to the rotation of the cam element, the pumping plunger moving within a cylindrical chamber 32. The chamber 32 is divided into a timing chamber 34 and a metering chamber 36. The timing chamber 34 when closed by operation of the solenoid 14 forms a hydraulic link between the pumping plunger and a metering plunger 40. The interplunger volume between the two plungers form the variable timing chamber 34. The lower end of the metering plunger 40 forms the upper surface of the metering chamber 36. The lower surface is formed by the bottom of the cylindrical chamber 32.

When the pumping plunger 30 is in its uppermost position and about to start its downward movement, the metering chamber 36 contains a premetered quantity of fuel which is to be injected into the engine cylinder. As will be seen from a further description of the control valve or solenoid 14 and its operation, as the plunger 30 starts its downward travel the timing chamber 34 is not sealed. Therefore fuel can be driven from the timing chamber 34 and the metering piston will remain in the position shown. Upon receiving a start of injection signal from the ECU, the timing chamber 34 is sealed to create a hydraulic link between pumping plunger 30 and metering plunger 40. This permits the metering plunger 40 to follow the motion of the pumping plunger 30 and to cause the fuel in the metering chamber 36 to be pressurized and ultimately injected into the engine. Injection is then terminated by venting the timing and metering chambers (34 and 36) through their respective dump passages (86 and 94).

When the pumping plunger 30 and metering plunger 40 are at their downmost position, the start of the metering phase of the cycle is commenced. In this case the timing chamber 34 remains sealed and the upward movement of the the plunger 30 tends to draw the metering plunger 40 upwardly in response to the reduced pressure created in the timing chamber 34 during its sealed mode of operation. As will be seen, fuel from the supply (not shown) is communicated to the supply port 38 and permitted to flow into the metering chamber 36 during the metering portion of the cycle. Thus, premetered fuel is placed in metering chamber 36 in accordance with either a pressure timing metering mode of operation or a volumetric metering mode of operation as will be fully explained hereafter. Once metering is to be terminated, the timing chamber 34 is unsealed and the flow of fuel to metering chamber 36 is shut off thereby terminating the metering of fuel into the metering chamber 36 and halting the upward movement of metering plunger 40.

Referring now to the control valve or solenoid 14, the solenoid includes a solenoid coil 44 used to control the reciprocal motion of an armature 46, a low pressure valve element 48 and a high pressure valve element 50. The valve elements 48 and 50 are mounted on a common shaft 52 which is, in turn, mounted on the armature 46. The solenoid is an on/off type device whereby the armature will assume one of two positions depending on whether the coil 44 is energized or de-energized.

Fuel is supplied to the solenoid 14 by means of a supply passage 54, and a passage 56, which supplies fuel to the interior portion of the solenoid with the valve elements in the positions shown, that is, the high pressure valve element 50 is closed against its seat 58 and the low pressure valve element 48 is open away from the seat 60. Fuel is permitted to flow past the low pressure seat 60 into the area adjacent the armature 46 and out through a passage 62. Passage 62 is in fluid communication with the metering chamber 36 through a ball-type check valve 64. The flow of fuel in passage 62 is controlled by means of a restricting orifice comprising a metering calibration screw 66 which, when threaded inwardly, constricts the passage 62 to reduce the flow of fuel in passage 62 by increasing the pressure drop across the threaded screw 66.

Thus, with the solenoid 14 in the position shown, the timing chamber 34 is sealed because the source of supply 54 through passage 56 is cut off from a passageway 68 which communicates the high pressure valve element 50 with the timing chamber 34. Thus, with the high pressure valve element 50 in the closed position as shown, the timing chamber 34 is sealed and, with the valve element 48 open, the source of supply fuel from passage 54 is in communication with the metering chamber 36 through passages 56 and 62 and ball valve element 64.

Describing now the metering portion of the cycle, and assuming that the valves 48 and 50 are in the positions shown, and further assuming that the pumping plunger 30 and the metering plunger 40 are in their downmost position, the start of metering will occur. The cam element associate with the engine permits the upward motion of pumping plunger 30 and the metering plunger 40 will start its upward movement at the start of metering. As pumping plunger 30 moves up, a reduced pressure will be created in the timing chamber 34 due to the fact that it is sealed and that its volume increases by virtue of the motion of the pumping plunger 30; and the metering piston 40 will be drawn upwardly. Fuel then flows from supply passage 54 through passage 56, past the low pressure valve 48 through passage 62 to the metering chamber 36 past ball valve 64. Metering will continue as long as the solenoid 14 is in the position shown.

When it is decided to terminate metering, the electronic control unit terminates the signal to solenoid coil 44. The bias spring 45 moves the low pressure valve element 48 into engagement with its seat 60 and moves the high pressure valve 50 away from its seat 58. This movement shuts off the flow of fuel from passage 56 to passage 62 thereby cutting off the flow of fuel to the metering chamber 36. Simultaneously, the timing chamber 34 is opened to the supply thereby permitting fuel to flow from passage 56 to the timing chamber 34 through passage 68. This stops the upward motion of metering plunger 40 and permits the continued upward motion of plumping plunger 30 to its uppermost position. Upon reaching its uppermost position the pumping plunger 30 starts downwardly and fuel is forced out from timing chamber 34 through passage 68.

When injection is to be initiated, the electronic control unit provides a signal to the coil 44 which reverses the position of the valve elements 48 and 50 to the positions shown. This again seals timing chamber 34 and the fuel therein is compressed, including the fuel in passageway 68. It is to be noted that the size of passage 68 need not be sufficiently large to quickly pressurize chamber 34 at the end of metering to thereby stop the upward motion of metering piston 40 as was the case with previous systems. In the present invention, no further fuel is permitted to be metered into the metering chamber 36 due to the fact that the low pressure valve is closed. Thus, the passage 68 may be relatively small and therefore it contains a small quantity of fuel which must be pressurized during the injection portion of the cycle. Upon pressurization of the timing chamber 34, the metering piston 40 is then driven downwardly to force the fuel in the metering chamber 36 out through a passage 70 which is in fluid communication with the needle valve 74 of nozzle portion 22. It is to be noted that the check valve 64 is seated by the pressurization of the fuel in metering chamber 36.

Referring now to the nozzle portion 22, it is seen that the passageway 70 is in fluid communication with a surface 72 on a needle valve 74. The increased pressure on surface 72 drives the needle valve 74 up to open the nozzle tip 76 and permit the fuel from the metering chamber 36 to be injected into the engine. The needle valve 74 is biased closed by means of a spring 80 contained in a chamber 82. Thus, the pressure on surface 72 acts against spring 80 to open the needle valve 74. Upon the completion of the injection portion of the cycle, the spring 80 forces the valve 74 closed.

Referring now to the dump portion of the cycle, which occurs at the end of injection to relieve the pressure in the various chambers and passageways of the injector. The metering piston 40 is at its downmost position, this causes a passageway 84 to be in fluid communication with the passageway 86 (metering chamber dump port). The metering chamber 36 is in communication with passage 84 through a passage 88. Thus, at the end of injection, the metering chamber 36 is in fluid communication with supply at passage 54 through a passage 90, chamber 82, and the passages 86 and 88.

Thus, pressure in the metering chamber 36 is fed back to supply through the passages 86 and 90. It is to be noted that passage 90 includes a restriction 92 which is utilized to delay the decay of pressure in the metering chamber to ensure that the metering plunger 40 moves upwardly a short distance. It is also seen that the pressure at surface 72 is fed back to the metering chamber 36 through passage 70 to dump the pressure adjacent the needle valve 74.

At the end of injection, the pumping plunger 30 has not moved to its downmost position and provision must be made to dump the fuel from the timing chamber 34 which remains at the end of injection. This is accomplished by the metering plunger 40 uncovering the passageway 94 (timing chamber dump port) when the metering plunger 40 is in its downmost position. This communicates the timing chamber 34 with a passageway 96 connected to a dump reservoir. Passage 94 and passage 96 are interconnected by means of a check valve 98 which closes during the metering function to preclude fuel from flowing from the dump reservoir into the timing chamber.

Referring now to FIG. 2, there is shown a timing diagram relating the pumping plunger speed with the degree of rotation of the cam. It is seen that the pumping plunger 30 builds up speed during its downward motion from its uppermost position to a maximum speed shown at (A). The cam then permits the pumping plunger to slow down to a dwell portion at (B) which dwell portion occurs when the metering plunger 40 is at its downmost position and the pumping plunger 30 is similarly at its downmost position. This dwell time is utilized to permit the metering plunger 40 to settle out any dynamics which may be inherent in the system and also to establish a reference time. Upon the return stroke the cam achieves a constant speed at (C) to permit the metering function to occur in a pressure-time metering mode of operation. In the pressure-time metering mode of operation the amount of time that the solenoid permits metering of fuel into the metering chamber is the critical factor while in the volumetric mode of operation the degree of rotation of the cam which determines the degree of upward motion of the metering plunger is the determinative factor. During the volumetric mode of operation it is desirable to eliminate the restriction imposed by the calibration screw 66.

Referring now to FIG. 3, there is illustrated a modification of the injector of FIG. 1. Particularly, the injector of FIG. 3 does not include a dump output but rather the pressure created within the injector is fed back to supply during the dump mode of operation. Also, the upward motion of the metering piston is limited.

In FIG. 3, it is seen that the pressure in the metering chamber 36 is dumped by passages 88 and 84 to a passage 100 which is in direct communication with the supply passage 56. The injector illustrated has a slightly modified metering plunger 102 due to the fact that a projection 104 has been formed at the bottom of the metering plunger 102. This projection interacts with a shoulder 106 formed in the metering chamber 36 to limit the upward motion of the the metering plunger 102 to preclude the plunger 102 rising too high.

Fuel is dumped from the timing chamber 34 by means of the passage 94 and the check valve 98. However, the output of the check valve 98 is fed to passage 90 through passage 110 which is connected to supply rather than to a dump reservoir.

It will be readily apparent to a skilled artisan that the foregoing embodiments of the present invention may be modified and be subject to numerous changes without departing from the basic inventive concepts. Consequently, the appended claim should be liberally construed and should not be unduly limited to the embodiments illustrated.

Having thus described the invention, what is claimed is:

1. An integer for controlling the flow of fuel from a source to an internal combustion engine having a body having a bore formed therein, a primary plunger actuated in response to engine rotation and a metering plunger, means for reciprocating said primary plunger; a timing chamber formed between the primary plunger and said metering plunger, a metering chamber partially defined by said metering plunger; said injector comprising: a three way valve means for controlling the flow of fuel to said timing and metering chambers comprising a first valve means for controlling fuel flow to the timing chamber, and a second valve means controlling fuel flow to the metering chamber, said first valve means being in one position to admit fuel to said timing chamber and in a second position to seal said timing chamber, said second valve means being in a first position to permit the flow of fuel to said metering chamber and being in a second position to shut off the flow of fuel to said metering chamber.

2. The injector of claim 1 wherein the first position of said first valve means is opposite in function to the first position of said second valve means.

3. The injector of claim 1 wherein said first valve means is in said first position prior to commencement of injection.

4. The injector of claim 3 wherein said first valve means is switched to said second position to initiate injection.

5. The injector of claim 4 wherein said second valve means is in said first position prior to commencement of injection.

6. The injector of claim 5 wherein said second valve means is in said first position at the start of injection, through injection and through metering.

7. The injector of claim 6 wherein said second valve means is switched to said second position to end metering of fuel to said metering chamber.

8. The injector of claim 1 further including a first dump passage to relieve fuel pressure from said timing chamber.

9. The injector of claim 8 further including a second dump passage to relieve fuel pressure from said metering chamber.

10. The injector of claim 8 wherein said first dump passage contains an orifice and is connected to the source.

11. The injector of claim 9 wherein said second dump passage contains an orifice and is connected to the source.

12. The injector of claim 8 wherein said three-way valve means includes: a coil, an armature electromagnetically controlled by said coil and wherein said first valve means and said second valve means are controlled in response to the movement of said armature.

* * * * *